United States Patent [19]

Tsuchida et al.

[11] 4,406,589

[45] Sep. 27, 1983

[54] COMPRESSOR

[75] Inventors: Masayuki Tsuchida; Toshio Inoue, both of Yokohama; Yoich Mizutani, Isehara; Toshitsugu Suzuki, Tokyo, all of Japan

[73] Assignees: Tokico Ltd., Kanagawa; Hitachi, Ltd., Tokyo, both of Japan

[21] Appl. No.: 237,314

[22] Filed: Feb. 23, 1981

[30] Foreign Application Priority Data

Feb. 29, 1980 [JP] Japan ..... 55-25949

[51] Int. Cl.[3] ..... F04B 49/00

[52] U.S. Cl. ..... 417/295; 417/300; 417/302; 417/303; 417/304

[58] Field of Search ..... 417/295, 300, 302, 303, 417/304, 307, 310

[56] References Cited

U.S. PATENT DOCUMENTS 2,997,227 8/1961 Ternent ..... 417/302
3,103,891 9/1963 Fulton et al. ..... 417/300

FOREIGN PATENT DOCUMENTS 357858 9/1922 Fed. Rep. of Germany .
1728459 6/1961 Fed. Rep. of Germany .
1403953 7/1963 Fed. Rep. of Germany .
3026203 7/1980 Fed. Rep. of Germany .

*Primary Examiner*—John J. Camby
*Attorney, Agent, or Firm*—Ladas & Parry

[57] ABSTRACT

A compressor comprises a main compressor body of compressing air, an unloader valve device provided at the suction side of the main compressor body, a bleeding pipe provided between the ejection side of the main compressor body and the unloader valve device, and a controlling valve mechanism provided inside the bleeding pipe. The controlling valve mechanism opens by detecting the fluid pressure at the ejection side of the main compressor body. Further, the unloader valve device has a check valve which opens upon-no-load operation and stopping of the operation of the main compressor body, a main valve which opens due to the air released through the bleeding pipe when the controlling valve mechanism opens, a bleeding passage for releasing the released air supplied to the suction side of the check valve, and a relief passage which communicates when the main valve opens, to release the released air to the suction side of the main compressor body.

13 Claims, 10 Drawing Figures

COMPRESSOR

BACKGROUND OF THE INVENTION

The present invention generally relates to compressors, and more particularly to a compressor provided with an unloader valve device at the suction side of the main compressor body, where the unloader valve device simultaneously possesses a feedback function, an air bleeding function, and a check valve function, to process the compressed air upon no-load operation.

Generally, in oil-cooled compressors such as a screw type compressor and a slide vane type compressor, the lubricating oil is used as a lubricant and a coolant, and fed back between the main compressor body and the oil separator.

Accordingly, in this type of an oil-cooled compressor, when the rotation of the main compressor body is stopped, the rotor rotates in the reverse direction due to the remaining oil pressure within the oil separator even upon a no-load state. Hence, the lubricant flows out from the air suction side. Moreover, the lubricant is circulated by rotating the main compressor body even upon a no-load operation. Furthermore, in order to reduce the power required, the air suction quantity is reduced, and the compressed air is released to the atmosphere through the air bleeding valve.

However, there were problems associated with the above described oil-cooled compressor.

Firstly, the means for preventing the generation of noise upon no-load operation, is not satisfactory. The unload noise is generated because, the suction side of the main compressor body becomes of a vacuum state due to the closing of the check valve provided in the suction side of the main compressor body and the pressure difference between the suction side and the ejection side becomes large, to intermittently apply a large back pressure on the edge surface of the screw rotor, and irregularly rotates the operating rotor to introduce abnormal vibrations in the rotor. Conventionally, there was a system in which a by-pass pipe is provided between the ejection side and the suction side of the main compressor body, and a by-pass valve provided halfway between the by-pass pipe detects the vacuum factor at the suction side of the compressor and opens, to feed back the compressed air within the tank or the oil separator into the suction side of the compressor, in order to prevent the above noise. Another system controlled the check valve at the suction side so that the check valve does not completely close. The generation of the above unload noise is effectively prevented by the above systems, however, in the above first system, there was a disadvantage in that the pipe became complex due to the necessity of the by-pass pipe, and that the apparatus became large. Furthermore, in the latter system, the pressure inside the tank remained high, and the reduction in the required power was not sufficient (20% to 30% of the rated valve). Moreover, there was a danger in that the lubricant could flow backwards upon stopping of the operation.

In addition, when the compressor is stopped, drain is easily introduced due to the cooling of the compressed air having high temperature and high humidity within the oil separator, and accordingly degrades the lubricant or introduce rust in the oil separator due to the above drain.

Secondly, the means for preventing the leakage of the lubricant upon stopping of the compressor operation is complex. That is, upon stopping of the operation, it is necessary to lower the dew-point temperature of the compressed air by lowering the pressure inside the oil separator, in order to suppress the generation of drain within the oil separator. However, when the pressure is exceedingly lowered, it takes too much time to reach a predetermined pressure upon restarting of the compressor operation. Accordingly, especially when the operation is to be stopped for a short period of time, the oil separator is in a pressure applied state where the pressure within the oil separator is maintained at a predetermined pressure capable of restarting the compressor, so that a predetermined air pressure can be obtained from the initial point of restarting. Hence, this results in the leakage of the lubricant together with the compressed air from the unloader valve during the stopping operation. Thus, in order to prevent the above drain, a check valve was provided in the air pipe between the main compressor body and the oil separator, and further, an oil stopping valve was provided in the oil pipe. Therefore, the pipe system became complex, and in addition, a check valve and an oil stopping valve were required.

Thirdly, the reliability factor and the response characteristic of the control system are degraded. That is, in the conventional compressors, even in a screw type compressor in which the pulsating flow is minimum, the valve opening operation of the pressure responding valve within the air bleeding pipe is performed by using the air pressure of the air which has passed the pressure maintaining valve on the way to the machine using the compressed air, from the compressor. Accordingly, delay in the response due to the pressure difference in the pipe or burn-out of the electric motor due to overload are introduced, for example, and the response characteristic and the reliability factor are degraded.

Fourthly, measures must be taken against pollution and noise related to the releasing of air. When the compressed air within the oil separator is released to the atmosphere through the air bleeding valve upon no-load operation, noise is introduced upon releasing of air, and oil mist is released in the atmosphere to pollut the inside of a soundproof box surrounding the compressor. Thus, a mist separator, an air bleeding silencer, and the like are required.

Fifthly, much time is required for the lubricant changing operation within the oil separator. In the conventional compressor, the stopping valve at the lower part of the oil separator is opened after the remaining pressure within the oil separator is completely released, in order to prevent ejection of the oil upon stopping of operation for a long time and changing of the lubricant, and the oil was drawn out by the own weight of the lubricant or by operating another compressor to supply the air pressure produced inside the oil separator. Accordingly, much time was required to change and bleed out the lubricant, and moreover, the operation to draw out the oil is troublesome.

SUMMARY OF THE INVENTION

Accordingly, a general object of the present invention is to provide a novel and useful compressor in which the above described problems have been overcome.

Another and more specific object of the present invention is to provide a compressor having an unloader valve device, where the unloader valve device comprises preventing means for preventing the generation of unload noise.

Another object of the present invention is to provide a compressor having an unloader valve device comprising preventing means for preventing the drain of the lubricant upon stopping of the compressor operation.

Still another object of the present invention is to provide a compressor having an unloader valve device comprising air bleeding means for releasing the compressed air.

Still another object of the present invention is to provide a compressor in which the unloader valve device within the compressor is controlled by the pressure of the compressed air within the air bleeding pipe. Accordingly, the reliability factor and the response characteristic of the control system are improved.

Further objects and features of the present invention will be apparent from the following detailed description when read in conjunction with the accompanying drawings.

DETAILED DESCRIPTION

Figure 1:
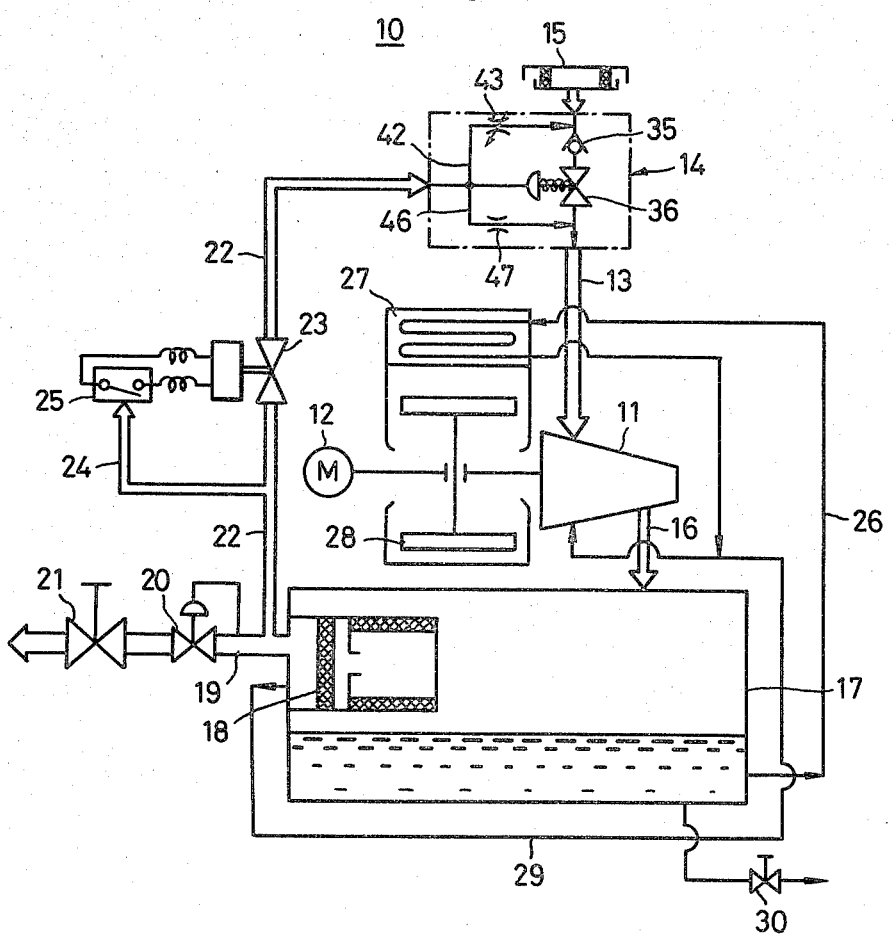
FIG. 1 is a diagram showing the whole system of a first embodiment of a compressor according to the present invention.

FIG. 1 shows an embodiment of an oil-cooled type compressor 10. A main compressor body 11 of a screw type or a slide vane type is driven by a motor 12. An unloader valve device 14 shown in FIG. 2A which forms the essential part of the compressor of the present invention, is provided halfway between an air suction side pipe 13 provided in the main compressor body. A suction filter 15 is provided at the suction side of the above loader valve device 14. An oil separator 17 is connected to an ejection side pipe 16 provided in the main compressor body 11, and a mist separator 18 is provided in the oil separator 17, for separating the oil component from the compressed air supplied under pressure together with the lubricant for cooling. The compressed air which is separated and purified at the mist separator 18 is maintained of its air pressure over a predetermined pressure at a pressure adjusting valve 20 provided in a pipe 19 for air, and is supplied to an operating machine through a stopping valve 21 and an air tank (not shown).

A bleeding pipe 22 is provided between the air pipe 19 and the unloader valve device 14. A solenoid valve 23 is provided halfway between the above bleeding pipe 22, and this solenoid valve 23 is operated by a pressure switch 25 connected to a by-pass pipe 24 branching away from the bleeding pipe 22. The contact point of the pressure switch 25 closes when the air pressure within the by-pass pipe 24 reaches a predetermined pressure, and opens due to a restoring pressure lower than the above predetermined pressure. When the contact point of the pressure switch 25 is closed, the solenoid valve 23 is open, and a controlling valve mechanism is constructed by the solenoid valve 23 and the pressure switch 25. Thus, the controlling valve mechanism is constructed to electrically detect the pressure of the compressed air within the system of the oil separator 17, and opens the solenoid valve 23. In addition, the operating pressure of the pressure switch 25 is selected in accordance with the pressure conditions of the machine to be operated.

Moreover, an oil pipe 26 which extends from the oil fluid within the oil separator 17, is connected to the suction side of the main compressor body 11. An oil cooling device 27 is provided halfway between the above oil pipe 26, and the oil cooling device 27 is cooled by a multi-blade fan 28 which is rotated by the motor 12. Further, a separated oil recovering pipe 29 is provided between the mist separator 18 and the main compressor body 11.

Figure 2A:
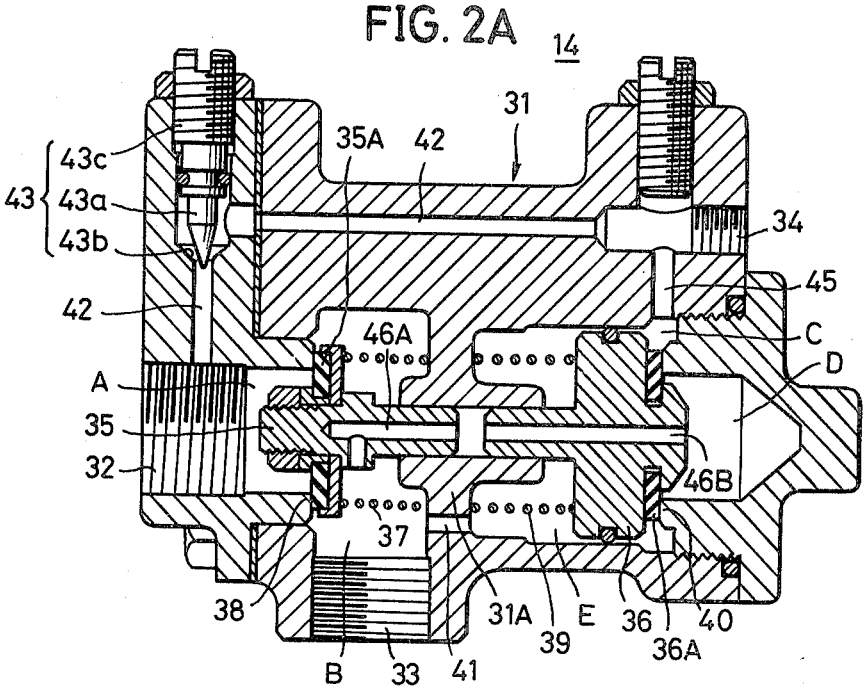
FIGS. 2A, 2B, and 2C are vertical sectional views respectively showing an embodiment of an unloader valve device which forms the essential part of the compressor shown in FIG. 1, in a state upon stopping of the compressor, in a state upon load operation, and in a state upon no-load operation.

The unloader valve device 14 is constructed as shown in FIG. 2A. A main valve body 31 comprises three members, mainly, a main body port and lid members respectively provided on both sides of the main body part containing the main body part therebetween and a spring receiving portion 31A formed at the center of the main valve body 31. The above main valve body 31 has a suction port 32 connected to the suction filter 15, an ejection port 33 connected to the suction side of the main compressor body 11 through the suction side pipe 13, and a supply port 34 connected to the oil separator 17 through the bleeding pipe 22.

Furthermore, a check valve 35 and a main valve 36 are respectively guided by the receiving portion 31A and provided on the same shaft within the main valve body 31.

The check valve 35 is provided between the suction port 32 and the ejection port 33, and is urged in the left hand side direction in FIG. 2A by a coil spring 37 provided between the check valve 35 and the spring receiving portion 31A. Accordingly, a valve body 35A makes contact with a valve seat 38 and partitions the passage into a chamber A on the air suction port side and a chamber B on the ejection port side.

The main valve 36 is urged in the right hand side direction in FIG. 2A due to a coil spring 39 provided between the main valve 36 and the spring receiving portion 31A. Therefore, a valve body 36A makes contact with a valve seat 40, to partition the passage into chambers C and D, respectively. A chamber E is formed between the main valve 36 and the spring receiving portion 31A, and this chamber E is always communicated to the chamber B through a passage 41.

In addition, an L-shaped bleeding passage 42 is formed within the main valve body 31, where one end of the bleeding passage 42 opens to the supply port 34 and the other end opens to the suction port 32. A variable throttle valve mechanism 43 having a valve portion **43*a*, a valve seat 43*b*, and a screw portion 43*c*, is provided halfway between the bleeding passage 42. This variable throttle valve mechanism 43** is opened to a predetermined state prior to the operation of the compressor 10.

Further, the supply port 34 and the chamber C are communicated by a main valve flow-in side passage 45.

Relief passages 46A and 46B are respectively formed in the check valve 35 and the main valve 36, along the axial direction thereof. One end of the relief passage 46A is open to the chamber B, and one end of the relief passage 46B is open to the chamber D. The relief passages 46A and 46B respectively function as a feed back passage to the main compressor body 11. Moreover, the diameters of these relief passages 46A and 46B are small, and function as a fixed throttle 47.

Next, the operation of the compressor of the above described construction, will be described.

Figure 2B:
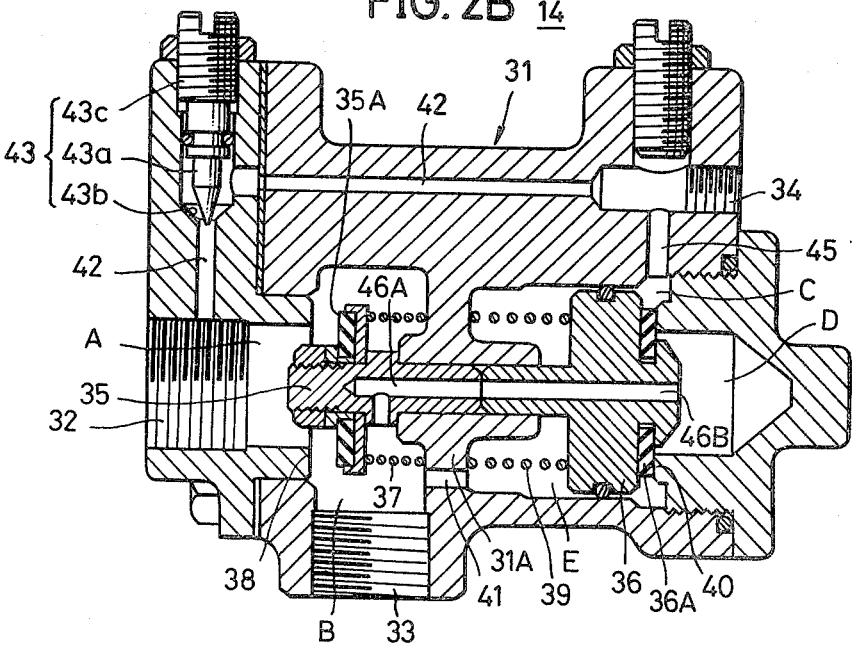

The main compressor body 11 is operated by the motor 12, and air is supplied inside the main compressor body 11 through the suction filter 15, unloader valve device 14, and the air suction side pipe 13, and applied with pressure therein. Inside the unloader valve device 14, the check valve 35 opens as shown in FIG. 2B against the force of the spring 37 by the difference in pressure at the front and at the rear of the check valve 35, due to the decrease in pressure within the chamber B. Accordingly, an air supplying passage is opened to the main compressor body 11, and the air suction quantity is automatically adjusted.

The air applied with pressure within the compressor body 11 is ejected inside the oil separator 17 together with the lubricant through the ejection side pipe 16. The compressed air inside the oil separator 17 is eliminated of the oil mist at the mist separator 18, and then supplied to the machine being used, through the pressure adjusting valve 20 and the stopping valve 21. The lubricant which is separated at the oil separator 17 and accumulated therein, is supplied to the main compressor body 11 through the oil pipe 26 and the oil cooling device 27. The rotor of the main compressor body 11 is operated while being lubricated and cooled, due to the lubricant supplied from the oil pipe 26 and the recovering pipe 29.

Figure 2C:
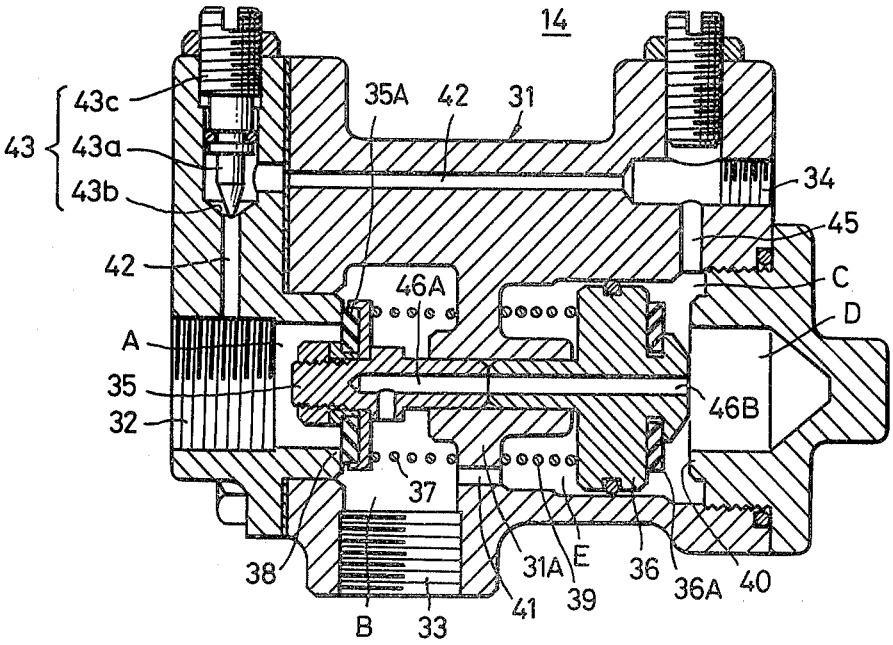

As the operation of the compressor 10 progresses, and the pressure inside the oil separator 17 rises to reach a pressure at which the no-load operation can be performed, this pressure acts on the pressure switch 25 through the by-pass pipe 24 to close the pressure switch 25, and thus, the solenoid valve 23 is opened. Furthermore, the unloader valve device 14 becomes of a state shown in FIG. 2C, and the compressor 10 is put in a no-load operating mode.

Accordingly, due to the opening operation of the solenoid valve 23, the released air reaches the support port 34 of the unloader valve device 14 through the bleeding pipe 22, and advances by branching away into the bleeding passage 42 and the passage 45.

The released air which advances within the bleeding passage 42 reaches the suction port 32 through the variable throttle valve mechanism 43 and is then released to the atmosphere, and therefore, the pressure inside the oil separator 17 gradually decreases. Since the releasing of air is performed through the suction filter 15, the pollution regulating effect is high, due to the releasing of air into the atmosphere after being separated of the excessive oil mist and transformed into purified air. Moreover, the suction filter 15 also functions as a silencer, and suppresses the noise upon releasing of air without especially providing a silencer. The releasing of air is continued until the pressure within the oil separator 17 decreases to the established lower limit pressure of the pressure switch 25, and the solenoid valve 23 recovers and closes.

Moreover, the main valve 36 opens against the force of the spring 39 due to the released air supplied to the chamber C through the passage 45. Thus, the check valve 35 is pushed by the main valve 36 and makes contact with the valve seat 38, and closes. Due to the opening operation of the main valve 36, the released air reaches the ejection port 33 through the chamber D and relief passages 46A and 46B, and is fed back into the main compressor body 11 from the air suction side pipe 13. By this feedback of the released air into the main compressor body 11, even when the check valve 35 is closed, a certain pressure exists within the air suction side pipe 13. Accordingly, the effect of the back pressure on the rotor is small, and the rotor rotates without irregular movements, generating no unload noise. The conventional by-pass pipe for reflux is thus not necessary because the relief passages 46A and 46B are provided, and the construction of the compressor is simplified.

In addition, upon no-load operation, the pressure inside the oil separator 17 decreases, and further, the released air is fed beck through the fixed throttle 47, and thus, the load of the main compressor body 11 is sufficiently reduced, to effectively reduce the power requirement of the motor 12.

When the pressure inside the oil separator 17 decreases to the established lower limit pressure of the pressure switch 25, the solenoid valve 23 closes and the bleeding pipe 22 closes to stop the releasing of air. Accordingly, the unloader valve device 14 is put in a state shown in FIG. 2B, and the compressor 10 changes from a no-load operating state into a load operating state.

When the motor 12 is stopped to stop the operation of the main compressor body 11, the rotor rotates in the reverse direction due to the remaining pressure within the oil separator 17. Therefore, the compressed air flows backwards from the ejection port 33 together with the lubricant inside the main compressor body 11. However, the unloader valve device 14 recovers into the state shown in FIG. 2A, and the drain of the lubricant is not introduced. That is, when the motor 12 is stopped upon load operation, the pressure difference between the chambers A and B in FIG. 2B becomes small, and the check valve 35 makes contact with the valve seat 38 due to the spring 37 and the reflux pressure and closes. Furthermore, when the motor 12 is stopped upon no-load operation, the reflux pressure acts on the main valve 36 through the passage 41 and the chamber E in FIG. 2C, to displace the main valve 36 in the right hand side direction so that the main valve 36 makes contact with the valve seat 40 and closes immediately. Accordingly, the check valve 35 and the main valve 36 close, to prevent drain of the circulated lubricant into the suction port 32 from the check valve 35, and although drain is introduced into the relief passages 46A and 46B, drain into the chamber C from the main valve 36 is prevented. In addition, since both the check valve 35 and the main valve 36 close positively, there is no need to provide an oil stopping valve within the oil pipe 26 or a check valve within the ejection side pipe 16, and the construction of the compressor is accordingly simplified.

Furthermore, the remaining air within the oil separator 17 is released to the atmosphere through the solenoid valve 23 which opens together with the stopping of the operation of the main compressor body 11, and the above bleeding passage 42. Hence, the pressure inside the oil separator 17 decreases to the atmosphere pressure, and the dew-point temperature decreases, and as a result, the drain is not easily generated even upon cooling. Accordingly, the degradation of the lubricant and the introduction of rust in the oil separator 17 due to the drain is effectively prevented.

In addition, when the compressor 10 is operating, the controlling valve mechanism is controlled by the use of the air pressure within the oil separator 17, and especially when the main compressor body 11 is of a screw type compressor in which the pulsating flow is small, the response characteristic and the reliability factor are improved.

When the lubricant within the oil separator 17 is to be drawn out upon stopping the operation of the main compressor body 11, the throttle valve mechanism 43 is operated to close the valve portion 43*a* by urging the valve portion 43*a* to make contact with the valve seat 43*b*, and to open the check valve 30. Thus, the extracting of oil can be performed rapidly by use of the remaining pressure inside the oil separator 17. Moreover, the operation to extract oil is even more facilitated when a locking mechanism is added to the throttle valve mechanism 43 to convert the mechanism into a so-called knocking type or a rapid type which is of a sliding type.

Figure 3:
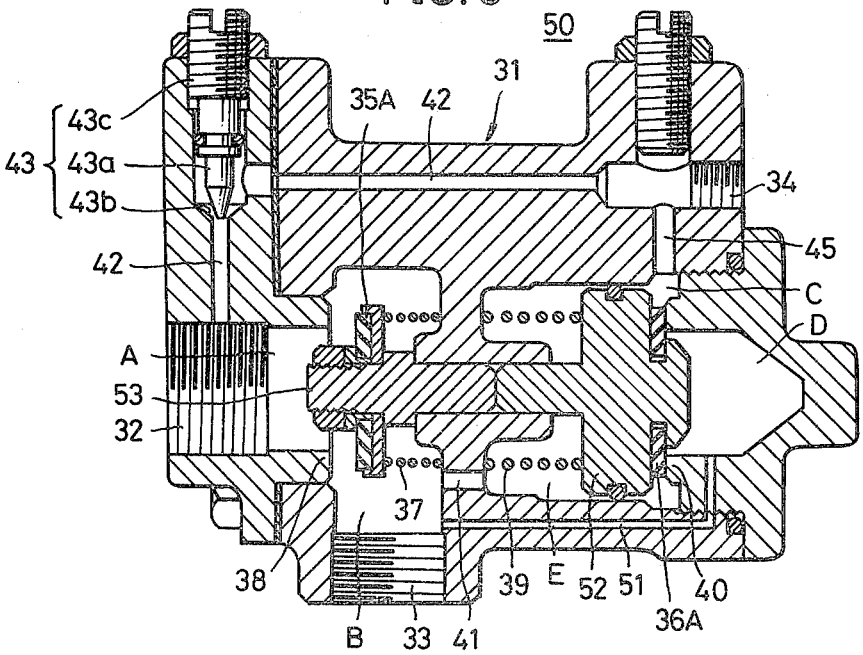
FIG. 3 is a vertical sectional view showing another embodiment of an unloader valve device in a state upon load operation.

Another embodiment of an unloader valve mechanism is shown in FIG. 3. In FIG. 3, those parts which are the same as those corresponding parts in FIG. 2B are designated by the like reference numerals and their description will be omitted. An unloader valve mechanism 50 is characterized in that a relief passage 51 is formed in the main valve body 31. One end of the relief passage 51 is open to the chamber B, and the other end is open to the chamber D. Accordingly, the function of the relief passage 51 is similar to the relief passage in FIG. 2B, however, no relief passages are formed in a main valve 52 or a check valve 53.

Figure 4:
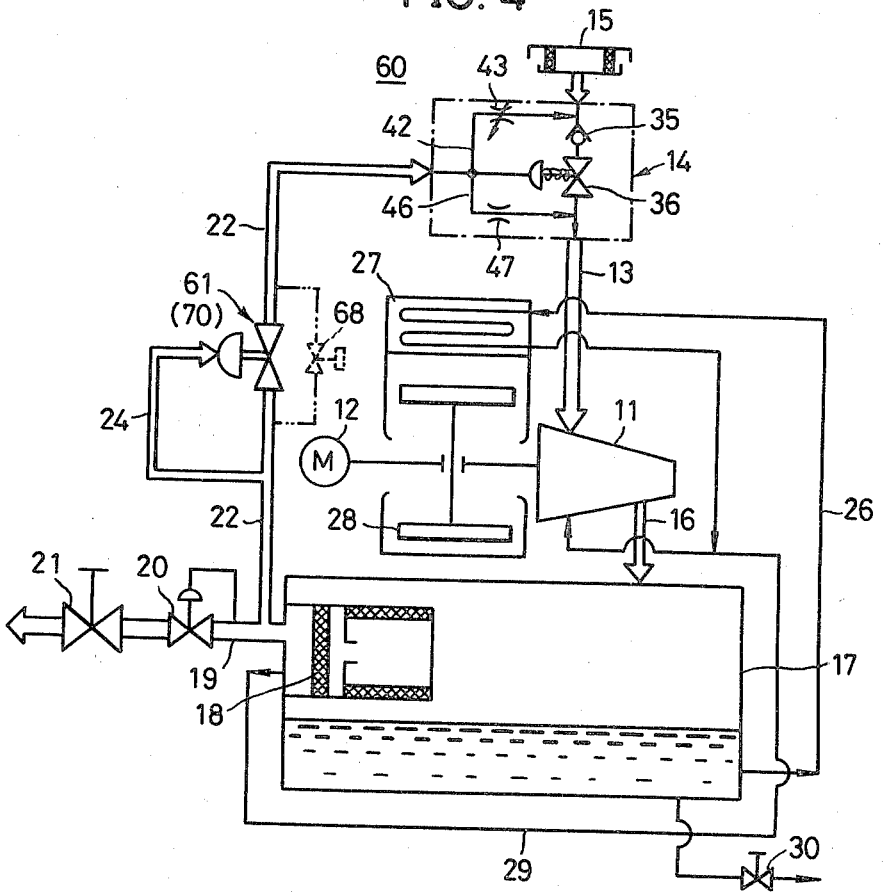
FIG. 4 is a diagram showing the system of a second embodiment of a compressor according to the present invention.
Figure 5:
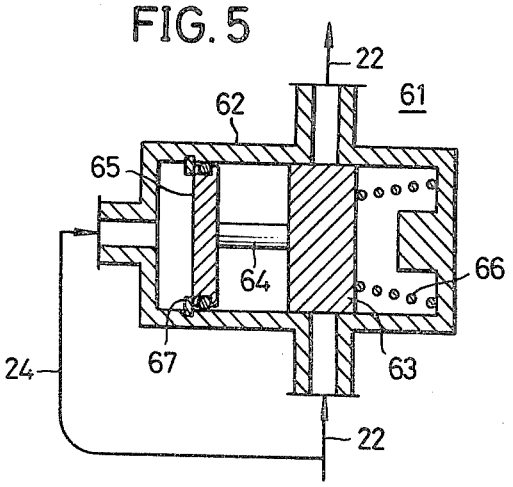
FIGS. 5 and 6 respectively are sectional views showing embodiments of a control valve mechanism which can be applied to the compressor shown in FIG. 4.

A second embodiment of a compressor according to the present invention is shown in FIG. 4. In FIG. 4, those parts which are the same as those corresponding parts in FIG. 1 are designated by the like reference numerals, and their description will be omitted. An oil-cooled compressor 60 mechanically detects the pressure of the compressed air within the system of the oil separator 17, to open a pressure adjusting valve 61. The pressure adjusting valve 61 comprises a piston 63 provided inside a main valve body 62 for opening and closing the bleeding pipe 22, a separating wall portion 65 connected through a valve shaft 64, a spring 66 inserted between the main valve body 62 and the piston 63, and a stopper 67 for locking the separating wall portion 65. Accordingly, when the pressure inside the by-pass pipe 24 becomes larger than a predetermined pressure, the separating wall portion 65 receives this pressure and moves the piston 63 in the right hand side direction in FIG. 5 against the force of the spring 66, to open the pressure adjusting valve 61. As a result, the released air is supplied to the supply port 34 of the unloader valve device 14 as in the above first embodiment of the invention, and the main compressor body 11 can then perform no-load operation. The pressure adjusting valve 61 shown in FIG. 5 is of a piston type, however, by use of a valve lid instead of the piston 63, a flexible material such as a diaphragm can be used for the separating wall portion 65. Moreover, a separate air bleeding valve can be provided, but by providing a solenoid valve 68 which opens together with the stopping of the main compressor body 11, in parallel with the pressure adjusting valve 61 as shown by the two-dot chain line in FIG. 4, drain is not generated within the oil separator 17 since the air is automatically released.

Figure 6:
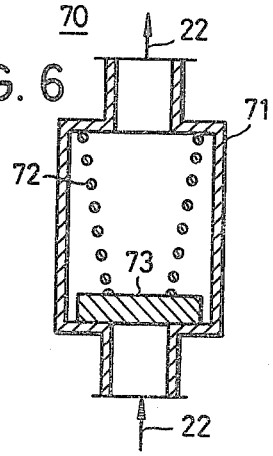

On the other hand, a pressure adjusting valve 70 shown in FIG. 6 is another embodiment of a pressure adjusting valve from that shown in FIG. 5. The pressure adjusting valve 70 comprises a check valve body 73 which is always urged in the valve closing direction by a spring 72, within a main valve body 71. Hence, this pressure adjusting valve 70 is used as a valve for adjusting the pressure in the check valve direction. Accordingly, by use of this type of a check valve, the controlling valve mechanism is further simplified.

Figure 7:
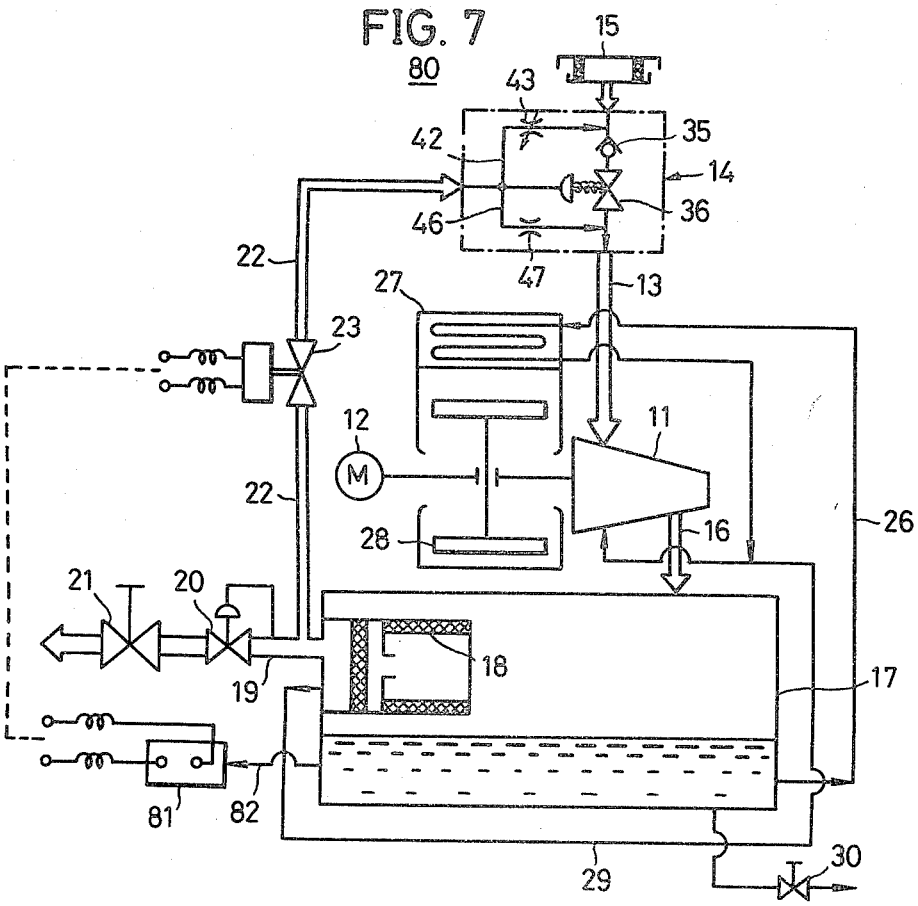
FIGS. 7 and 8 respectively are diagrams showing the systems of a third and fourth embodiments of a compressor according to the present invention.
Figure 8:
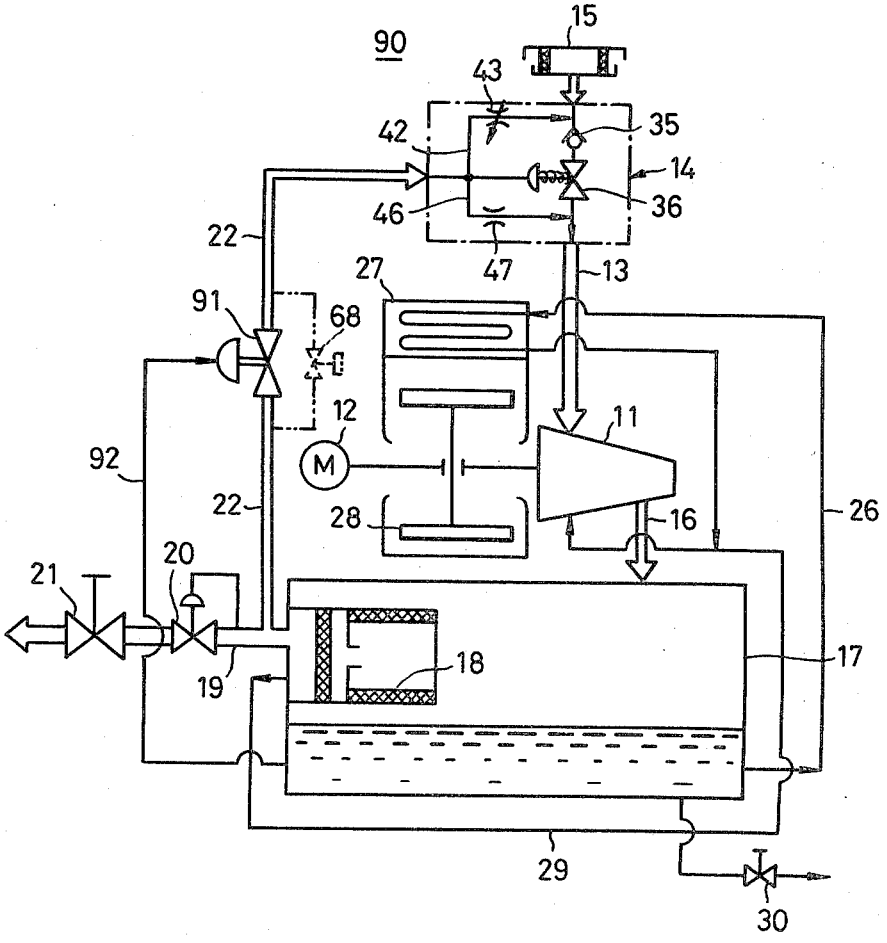

FIGS. 7 and 8 respectively show a third and fourth embodiments of a compressor according to the present invention. In FIGS. 7 and 8, those parts which are the same as those corresponding parts in FIGS. 1 and 4 are designated by the like reference numerals, and their description is omitted. Both embodiments of the invention are constructed to operate the controlling valve mechanism by detecting the pressure of the lubricant accumulated within the oil separator 17.

In an oil-cooled compressor 80 shown in FIG. 7, a pressure switch 81 communicates to the lower part of the oil separator 17 through a by-pass pipe 82. The pressure switch 81 is electrically connected to the solenoid valve 23, and when the pressure of the lubricant becomes of a predetermined pressure, the contact point of the pressure switch 81 closes to open the solenoid valve 23.

In an oil-cooled compressor 90 shown in FIG. 8, a pressure adjusting valve 91 communicates to the lower part of the oil separator 17 through a by-pass pipe 92. The pressure adjusting valve 91 opens and closes by mechanically detecting the pressure of the lubricant within the system of the oil separator 17.

The pressure of the lubricant within the oil separator 17 is substantially equal to the pressure of the compressed air, and the pressure response characteristic of the lubricant is superior to that of the compressed air. Furthermore, no effects of the pulsating flow are introduced in the pressure of the lubricant, and thus, the reliability factor and the response characteristic of the control system becomes superior.

In addition, descriptions were made on the oil-cooled compressors in each of the above embodiments of the invention, however, the present invention is not limited to the oil-cooled type, and can be realized in an air-cooled type (dry type) compressor. In this case, an air tank is provided instead of the oil separator.

Further, this invention is not limited to these embodiments but various variations and modifications may be made without departing from the scope of the invention.

What is claimed is:

1. A compressor comprising:

a main compressor body for compressing air;

an unloader valve device comprising a suction port, an ejection port, and a supply port, said ejection port being coupled to a suction side of said main compressor body;

a bleeding pipe provided between an ejection side of said main compressor body and said supply port of said unloader valve device; and a controlling valve mechanism provided inside said bleeding pipe, for detecting fluid pressure at the ejection side of said main compressor body and opening when the detected fluid pressure reaches a predetermined fluid pressure, said controlling valve mechanism opening when said main compressor body stops operating, said unloader valve device comprising a check valve provided between said suction port and said ejection port, a main valve provided between said ejection port and said supply port, a bleeding passage provided between and supply port and said suction port, and a relief passage provided between said ejection port and said main valve, said check valve opening and automatically adjusting supply of air to said main compressor body during a loaded operation mode of said compressor, and closing during a no-load operation mode of said compressor and when said main compressor body stops operating, said main valve means opening due to air released through said bleeding pipe when said controlling valve mechanism opens, and operating to close said check valve, said bleeding passage releasing air supplied from said bleeding pipe to said check valve through said suction port, said relief passage releasing air supplied from said bleeding pipe to the suction side of said main compressor body when said main valve opens, to maintain a certain pressure at the suction side of said main compressor body when said check valve means is closed.

2. A compressor as claimed in claim 1 which further comprises an oil separator provided between the ejection side of said main compressor body and said controlling valve mechanism, said oil separator comprising a mist separator for separating a lubricant component from compressed air including the lubricant supplied from said main compressor body, for producing and supplying purified compressed air to said controlling valve mechanism.

3. A compressor as claimed in claim 1 in which said unloader valve device further comprises a variable throttle valve mechanism inside said bleeding passage, said throttle valve mechanism being normally partially open.

4. A compressor as claimed in claim 1 in which said relief passage is formed inside said main valve and said check valve.

5. A compressor as claimed in claim 1 in which said relief passage is formed inside a main valve body of said unloader valve device.

6. A compressor as claimed in claim 1 in which said controlling valve mechanism comprises a pressure switch for electrically detecting the fluid pressure at the ejection side of said main compressor body, and a solenoid valve provided inside said bleeding pipe, said solenoid valve being operated by said pressure switch.

7. A compressor as claimed in claim 1 in which said controlling valve mechanism has a separating wall portion which mechanically detects the fluid pressure at the ejection side of said main compressor body and undergoes displacement, and a valve portion provided inside said bleeding pipe, said valve portion being operated and opened due to the displacement of said separating wall portion.

8. A compressor as claimed in claim 6 in which said controlling valve mechanism further comprises an oil separator provided between the ejection side of said main compressor body and said solenoid valve, said oil separator comprising a mist separator for separating a lubricant component from compressed air including the lubricant supplied from said main compressor body, for producing and supplying purified compressed air to said solenoid valve, and a by-pass pipe provided between said oil separator and said pressure switch, for guiding the purified compressed air from said oil separator to said pressure switch.

9. A compressor as claimed in claim 7 in which said controlling valve mechanism further has an oil separator provided at the ejection side of said main compressor body, and a by-pass pipe for guiding the compressed air inside said oil separator to said separating wall portion.

10. A compressor as claimed in claim 6 in which said controlling valve mechanism further comprises an oil separator provided between the ejection side of said main compressor body and said solenoid valve, said oil separator comprising a mist separator for separating a lubricant component from compressed air including the lubricant supplied from said main compressor body, for producing and supplying purified compressed air to said solenoid valve, and a by-pass pipe provided between said oil separator and said pressure switch, for releasing the pressure of the lubricant separated and accumulated inside said oil separator to said pressure switch.

11. A compressor as claimed in claim 7 in which said controlling valve mechanism further has an oil separator provided at the ejection side of said main compressor body, and a by-pass pipe for releasing the pressure of the lubricant separated and accumulated inside said oil separator to said separating wall portion.

12. A compressor as claimed in claim 1 in which said controlling valve mechanism further comprises a check valve which opens according to the air pressure at the ejection side of said main compressor body.

13. A compressor as claimed in claim 1 which further comprises a filter coupled to said suction port of said unloader valve device, for filtering incoming air, said released air from said bleeding pipe obtained through said bleeding passage being released through said filter during the no-load operation mode of said compressor, said filter eliminating generation of oil mist and noise upon releasing of air during said no-load operation mode.

* * * * *